US006551401B1

(12) United States Patent
Winistorfer et al.

(10) Patent No.: US 6,551,401 B1
(45) Date of Patent: Apr. 22, 2003

(54) MACHINE FOR COLORING LANDSCAPING MATERIAL

(75) Inventors: John R. Winistorfer, Marion, IA (US); Douglas E. Grunder, Mt. Vernon, IA (US); Brent Lester, Roland, IA (US)

(73) Assignee: Becker-Underwood, Inc., Ames, IA (US)

( * ) Notice: Subject to any disclaimer, the term of this patent is extended or adjusted under 35 U.S.C. 154(b) by 50 days.

(21) Appl. No.: 09/692,377

(22) Filed: Oct. 19, 2000

(51) Int. Cl.[7] ..... B05C 5/00

(52) U.S. Cl. ..... 118/303; 118/19; 118/24; 366/244

(58) Field of Search ..... 118/303, 19, 24; 366/244, 154.1, 155.1, 155.2, 156.2

(56) References Cited

U.S. PATENT DOCUMENTS

| | | | | |
|---|---|---|---|---|
| 649,232 A | | 5/1900 | Berger | |
| 1,735,393 A | | 11/1929 | Hiller | |
| 1,792,059 A | | 2/1931 | Altwegg | |
| 1,870,980 A | | 9/1932 | Altwegg | |
| 1,948,871 A | | 2/1934 | Quehl | 259/9 |
| 1,996,395 A | | 4/1935 | Arnold | 99/11 |
| 2,519,649 A | | 8/1950 | Gustafson | 91/18 |
| 2,538,891 A | * | 1/1951 | Zimmerman et al. | 118/303 |
| 2,702,018 A | | 2/1955 | Gustafson | 118/417 |
| 2,892,443 A | | 6/1959 | Lodige et al. | 118/303 |
| 3,130,070 A | | 4/1964 | Potters et al. | 117/100 |
| 3,198,655 A | | 8/1965 | Gisiger | 117/100 |
| 3,421,740 A | | 1/1969 | Behrens | 259/41 |
| 3,422,792 A | | 1/1969 | Rollette | 118/5 |
| 3,734,471 A | | 5/1973 | Engels | 259/6 |
| 3,734,777 A | | 5/1973 | Bratschitsch | 134/132 |
| 3,916,825 A | | 11/1975 | Schnitzler et al. | 118/303 |
| 3,968,771 A | | 7/1976 | Walgenbach et al. | 118/303 |
| 4,015,830 A | | 4/1977 | Lödige et al. | 259/25 |
| 4,067,140 A | | 1/1978 | Thomas | 47/9 |
| 4,079,696 A | | 3/1978 | Weber | 118/417 |
| 4,188,130 A | | 2/1980 | Engels | 366/228 |
| 4,202,636 A | | 5/1980 | Vanderveen | 366/319 |
| 4,370,945 A | | 2/1983 | Beckschulte et al. | 118/303 |
| 4,390,285 A | | 6/1983 | Dürr et al. | 366/168 |
| 4,394,845 A | | 7/1983 | Porter et al. | 118/303 |
| 4,449,826 A | | 5/1984 | Mathis et al. | 366/13 |
| 4,516,524 A | | 5/1985 | McClellan et al. | 118/683 |

(List continued on next page.)

FOREIGN PATENT DOCUMENTS

| | | |
|---|---|---|
| DE | 21 34 305 | 7/1971 |
| DE | 23 44 231 | 9/1973 |
| DE | 24 28 588 | 6/1974 |
| DE | 24 42 955 | 9/1974 |
| DE | 30 16 031 | 4/1980 |
| GB | 1 099 941 | 1/1968 |
| RU | 438531 | 8/1974 |
| RU | 617083 | 7/1978 |
| RU | 665836 | 6/1979 |

OTHER PUBLICATIONS

"The Revolutionary Second Harvester™ Mulch Coloring System" Becker Underwood, Inc., prior Aug. 2000, 2 pages double sided.

*Primary Examiner*—Richard Crispino
*Assistant Examiner*—Yewebdar T Tadesse
(74) *Attorney, Agent, or Firm*—Drinker Biddle & Reath LLP

(57) ABSTRACT

A machine for coloring landscaping material is defined as having first and second mixing chamber segments in which liquid colorant is introduced into the first segment in the form of a liquid spray and into the second segment in the form of an aerosol. Paddles supported by arms secured to a rotating shaft are provided through the first and second segments to mix and convey the landscaping material during coloring. Increased tip speed of the paddles is provided by relatively longer arms in the second segment to enhance interaction between the landscaping material and the aerosol colorant.

20 Claims, 8 Drawing Sheets

U.S. PATENT DOCUMENTS

| | | | | |
|---|---|---|---|---|
| 4,527,902 | A | | 7/1985 | Christen ..... 366/169 |
| 4,542,041 | A | | 9/1985 | McClellan et al. ..... 427/212 |
| 4,586,459 | A | | 5/1986 | Schultz ..... 118/303 |
| 4,670,302 | A | | 6/1987 | Oldemeyer et al. ..... 427/212 |
| 4,689,249 | A | | 8/1987 | Thygesen ..... 427/180 |
| 4,794,022 | A | | 12/1988 | Johnson et al. ..... 427/212 |
| 4,987,850 | A | | 1/1991 | McCracken ..... 118/303 |
| 5,028,299 | A | | 7/1991 | Guidat et al. ..... 162/24 |
| 5,192,587 | A | | 3/1993 | Rondy ..... 427/212 |
| 5,308,653 | A | | 5/1994 | Rondy ..... 427/212 |
| 5,354,127 | A | | 10/1994 | Del Zotto et al. ..... 366/27 |
| 5,358,738 | A | | 10/1994 | Sawka ..... 427/220 |
| 5,401,534 | A | | 3/1995 | Bourreau et al. ..... 427/212 |
| 5,538,747 | A | | 7/1996 | Mueller ..... 246/507 |
| 5,543,172 | A | | 8/1996 | Jakubisin et al. ..... 427/212 |
| 5,582,644 | A | * | 12/1996 | Gaddis et al. ..... 118/303 |
| 5,866,201 | A | | 2/1999 | Blue ..... 427/212 |
| 6,007,859 | A | * | 12/1999 | Taylor et al. ..... 118/303 |
| 6,328,798 | B1 | * | 12/2001 | Bostrom et al. ..... 118/303 |

* cited by examiner

MACHINE FOR COLORING LANDSCAPING MATERIAL

FIELD OF THE INVENTION

The present invention relates to an apparatus for coloring landscaping material, and more particularly to an apparatus for coloring landscaping material incorporating a liquid atomizer.

BACKGROUND OF THE INVENTION

Landscaping material includes: aggregate; stones; mulches made from wood and bark and other materials. Such landscaping material is used for many gardening and landscaping applications and is commonly made from grinding, chopping or otherwise reducing material into the form of chips or granular or particulate matter. The marketability of such products, particularly for decorative landscaping purposes, depends greatly on the appearance of the product and in particular on the color of the product.

Coloring agents have been used to artificially color landscaping material to increase marketability. The coloring agents allow for greater control and uniformity in the appearance of the product. The coloring agents commonly used include solutions in concentrated form having the desired coloring pigment which are mixed with water prior to introduction to landscaping material to be colored. The coloring mixture may also include additional admixtures such as resins and other surfactants.

Machines for coloring landscaping material have incorporated varying material handling systems and colorant distribution systems. U.S. Pat. No. 5,192,587 to Rondy, for example, discloses the use of a continuous auger screw for conveying wood chips through an upwardly angled trough. A basin near a lower end of the trough contains a supply of a colorant solution to immerse the wood chips prior to conveying. Excess colorant drains from the wood chips as they are conveyed up the trough. A desired object of the system is stated to be rapid processing of material. However, saturation of the wood chips by immersion in a basin is wasteful in terms of colorant usage. Also, the continuous helical surface of the auger screw, while providing for rapid conveyance of material, provides limited mixing of material during the conveyance.

In U.S. Pat. No. 5,308,653 to Rondy the immersion basin is replaced with a falling wall of liquid colorant from a slit pipe extending across the inlet to the conveyor. Also disclosed are radial projections from the auger shaft between the helical screw flight at spaced locations for agitation of the wood product being conveyed. Again, excess colorant is applied which is recaptured at a lower end of the angled conveyor. The use of projections intermediate to the rotating screw, provides only limited agitation.

U.S. Pat. No. 5,358,738 to Sawka includes a housing with rotating screw auger for conveying wood chips through the inclined trough. Colorant is applied in a first half of the conveyor immediately downstream of the inlet through the use of spaced nozzles. A second half of the conveyor is open to the atmosphere. Again, the limited agitation associated with the auger screw necessitates that significant excess colorant be applied to the wood chips being conveyed.

The colorant distribution systems and material handling systems of the prior art lead to inefficiencies in colorant usage and less than optimum colorant dispersal throughout the raw wood and/or bark materials.

It is therefore an object of the present invention to provide an apparatus for coloring landscaping material having a colorant distribution system and material handling system which preferably increases the mixing action and exposes more of the material surface to the colorant. This improvement results in increased uniformity in colorant distribution throughout the landscaping material, results in increased efficiency in colorant usage and limits moisture content of the material on discharge.

SUMMARY OF THE INVENTION

According to the present invention there is provided an apparatus for coloring landscaping material. The apparatus includes a mixing chamber having first and second elongated segments each with an internal cavity which are in communication with one another. A colorant distribution system is provided for delivery of a liquid colorant. The distribution system has first and second portions, with the first portion being within the first segment of the mixing chamber and providing delivery of colorant in the form of a liquid spray, and the second portion extending within the second segment of the mixing chamber, having a liquid atomizer to provide for delivery of colorant in aerosol form. A material handling system extends through the first and second segments for agitating, mixing and conveying landscaping material through the mixing chamber, from the first segment to the second segment and out of the chamber at the discharge.

According to one embodiment of the present invention, the material handling system includes a rotatably supported drive shaft extending through the first and second segments. A series of paddles are secured to arms that extend from the rotating shaft at various positions and are oriented to impart tangential and axial movement to the landscaping material. Various paddles are oriented to impart a forward axial movement in a downstream direction within respect to the mixing chamber and various other paddles are oriented to impart a reverse axial movement in an upstream direction.

According to an embodiment of the present invention, the paddles in the larger second segment of the mixing chamber are supported on relatively longer arms than the paddles of the first segment, resulting in increased tip speed for the paddles of the second segment, which are both rotating on the same shaft.

According to another embodiment of the present invention, the apparatus includes a flow controller between the first and second segments. The flow controller extends transversely with respect to an elongated length of the second segment, across an upper portion of the internal cavity of the second segment. The flow controller directs material from the first segment to the second segment through the lower portion of the mixing chamber. The apparatus may further include one or more secondary flow controllers transversely extending into the second segment. These secondary flow controllers preferably extend across a lower portion of the second segment for directing a flow of material through an upper portion of the chamber. Each of the flow controllers serves to restrict the flow toward the discharge, to increase agitation, and to increase residence time.

According to one embodiment of the present invention, the apparatus includes a material sensor extending into a hopper supported above the first segment of the chamber. The hopper retains a supply of landscaping material to be colored. The sensor provides a system start signal to a control unit for start up of the colorant and/or the material handling system following detection by the sensor that a level of landscaping material within the hopper has reached the sensor.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
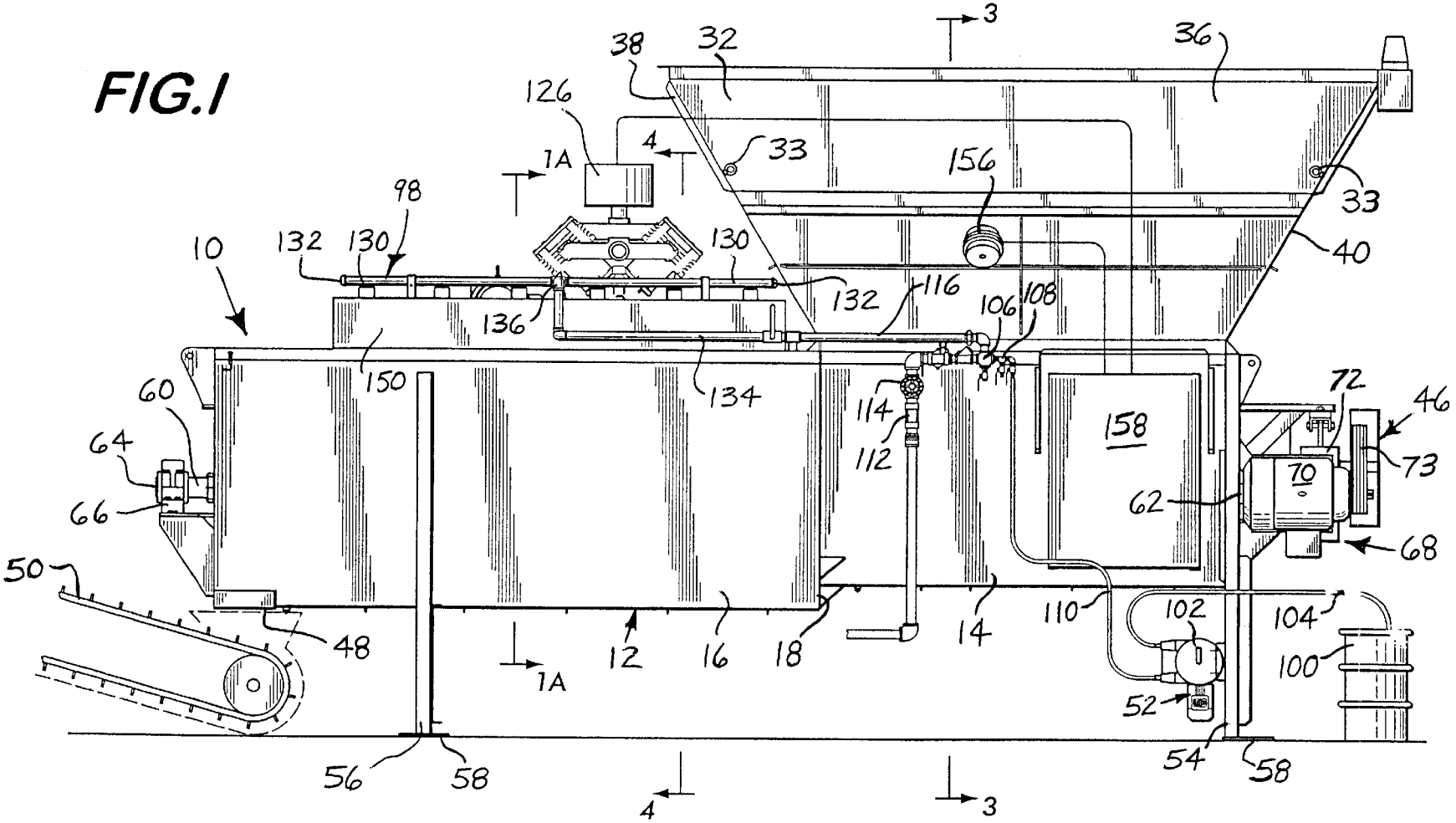
FIG. 1 is a side elevational view of an apparatus for coloring landscaping material according to the present invention.

Referring to the figures, where like numerals identify like elements, there is illustrated an apparatus for coloring a particulate or granular material to create landscaping material. Such landscaping material includes: aggregate; stone; mulches made from wood and bark and other materials. The landscaping material typically has been processed by grinding, chopping or otherwise reducing the material to form a granular or particulate material. The apparatus is generally referred to by the numeral 10 and includes a mixing chamber 12 having an elongated first segment 14 abutting an elongated second segment 16 at a segment juncture 18. The segments 14, 16 have internal cavities 20, 22, respectively, which communicate with one another at the juncture 18. As best seen in FIG. 1A, each of the segments 14, 16 includes an upper portion 24 and 26, respectively, which is generally rectangular in cross section and a lower portion 28 and 30, respectively, and which is generally semi-circular in cross section. The internal cavity 22 of second segment 16 is larger in cross sectional area than the internal cavity 20 of first segment 14. The segmented construction of the mixing chamber 12 provides for a segmented treatment of the landscaping material in which colorant is introduced in each of the segments 14, 16 and the landscaping material is handled in each of the segments in a manner which is distinct from the other segment.

Figure 1A:
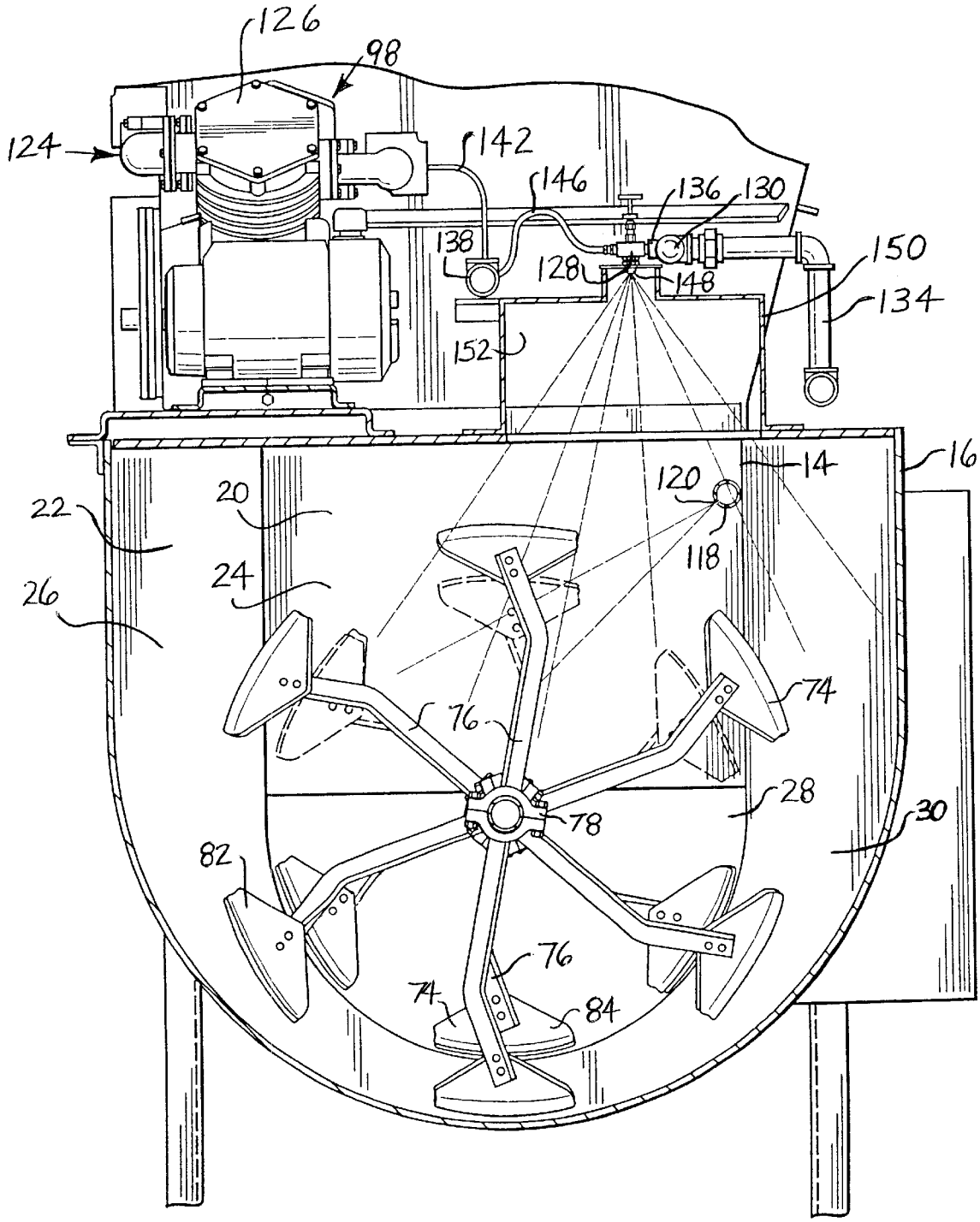
FIG. 1A is a sectional view taken along lines 1A—1A in FIG. 1.
Figure 2:
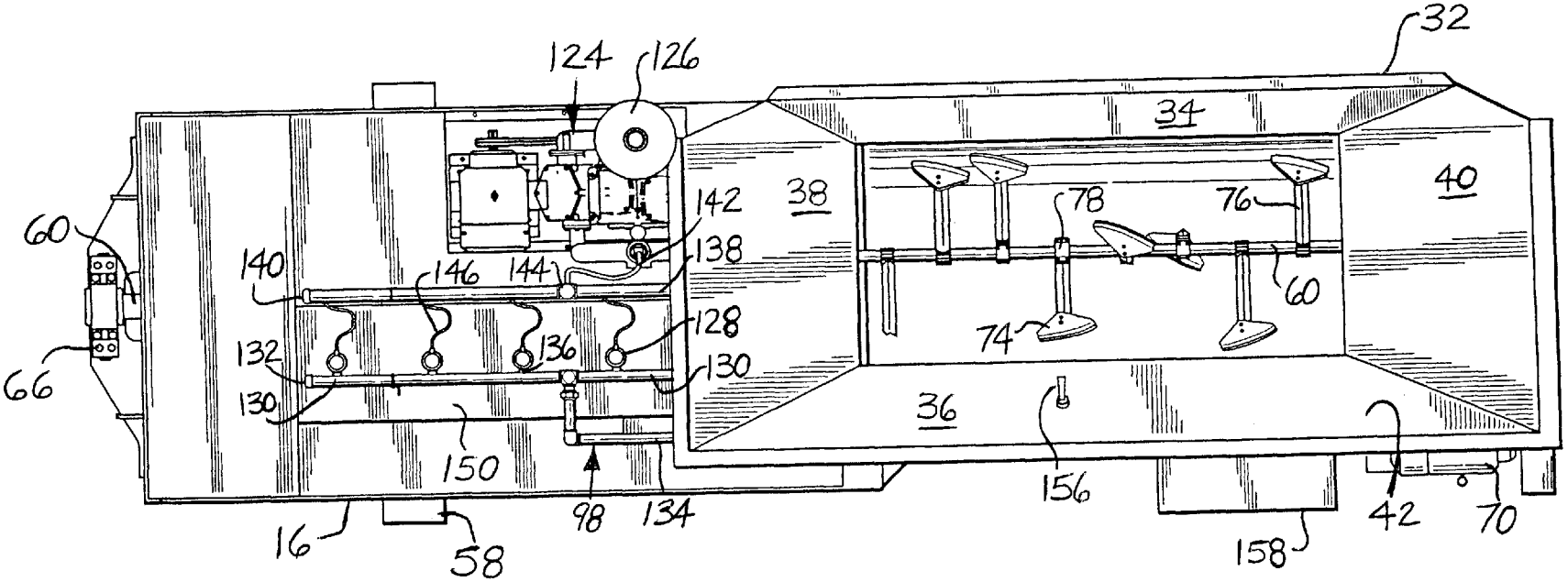
FIG. 2 is a top plan view of the apparatus of FIG. 1.

With reference to FIGS. 1 and 2, the following describes certain structural features of apparatus 10 and briefly introduces the systems providing for the segmented treatment of landscaping material. Uncolored material is introduced into a hopper 32 which is supported above the first segment 14 of the mixing chamber 12. The hopper includes lifting eyelets 33 to facilitate handling of the hopper during installation or removal of the hopper from the first segment 14 of mixing chamber 12. The hopper 32 includes side walls 34, 36 and end walls 38, 40 forming an internal cavity 42 which communicates with the internal cavity 20 of first segment 14 at an inlet 44 in first segment 14. The material delivered via hopper 32 is conveyed through, and mixed within, the mixing chamber 12 by a material handling system 46. The material handling system, as will be described, provides distinct handling of landscaping material in each of the first and second segments 14, 16. The landscaping material is conveyed by the material handling system to a discharge opening 48 located adjacent an end of second segment 16 opposite first segment 14 for delivery of colored material to a conveyor 50, for example, for transport of colored material away from mixing chamber 12. A colorant distribution system 52 delivers a liquid colorant to segments 14, 16 of mixing chamber. The colorant distribution system 52, as will be described, provides for delivery of colorant in each of the segments 14, 16 in a manner which is distinct for each of the segments. The mixing chamber 12 is supported at a distance above grade by spaced apart support members 54, 56 each including load spreading pads 58.

The following describes the construction and function of the material handling system 46 in greater detail. The material handling system 46 includes a drive shaft 60 which extends through the internal cavities 20, 22 of segments 14, 16 and which is rotatably supported adjacent opposite ends 62, 64 of shaft 60 by roller bearing assemblies 66. The drive shaft 60 is rotatably driven by a shaft drive system 68 which includes a drive motor 70 secured to support member 54, a reducer 72 mounted on drive shaft 60, and a continuous drive belt 73 linking drive motor 70 to reducer 72.

Figure 4:
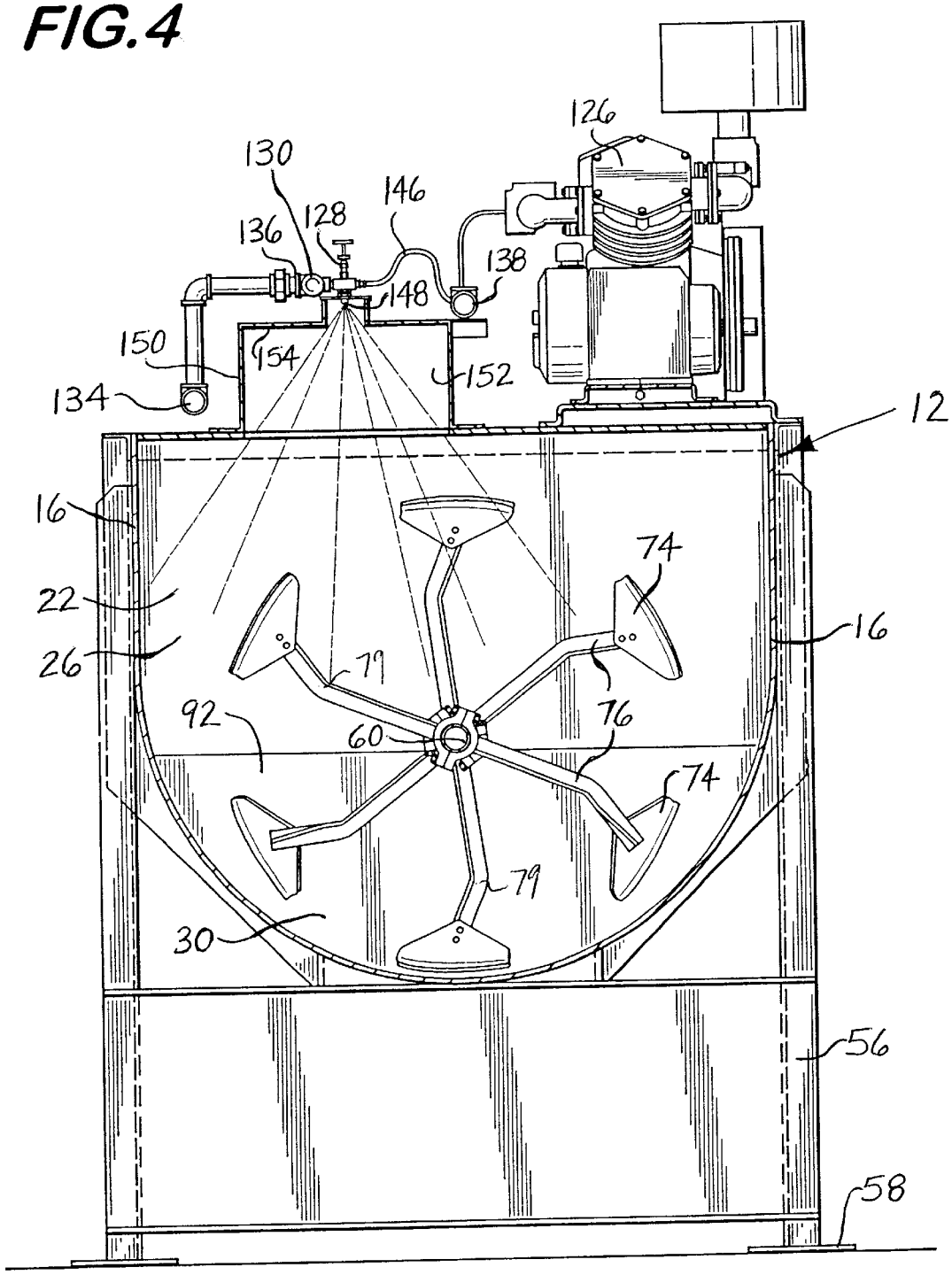
FIG. 4 is a sectional view taken along lines 4—4 in FIG. 1.
Figure 4A:
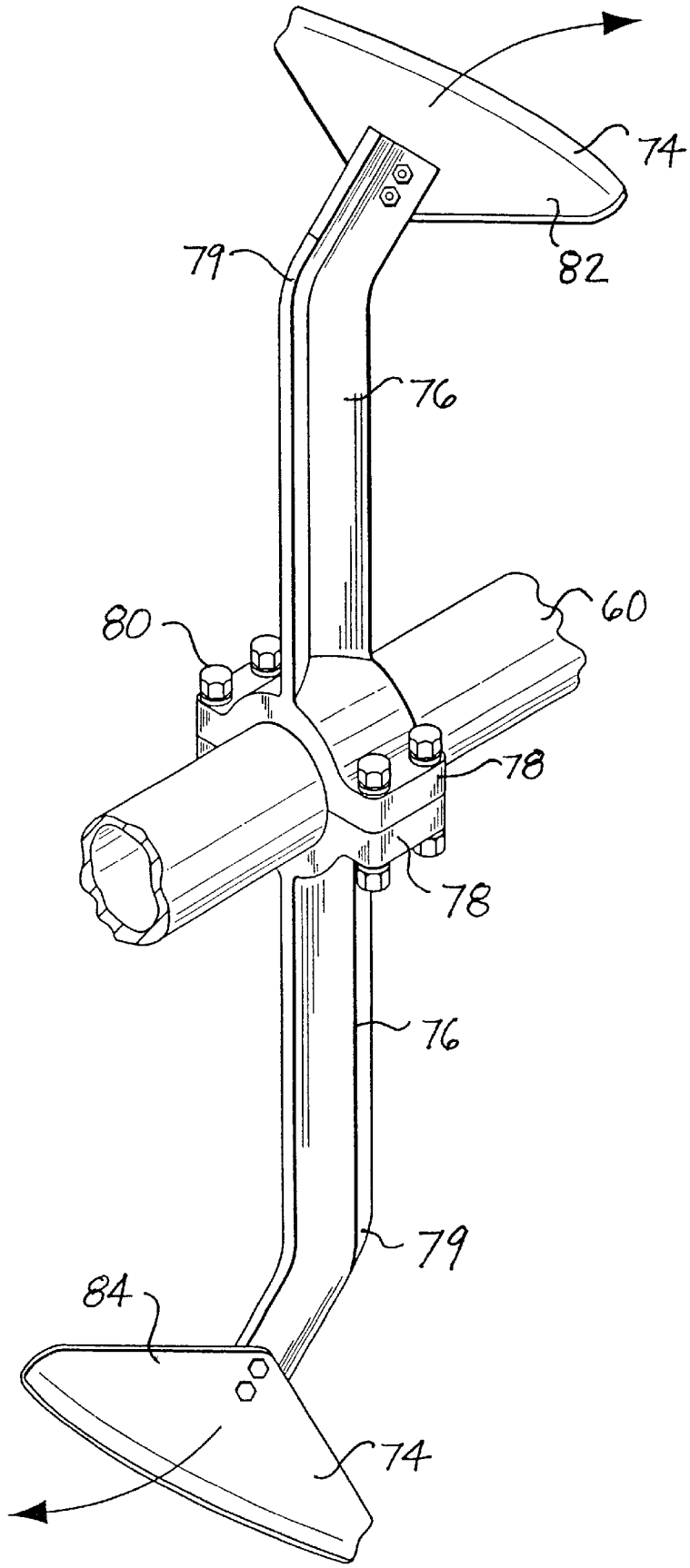
FIG. 4A is a partial perspective view of a shaft, collars, arms and paddles for the apparatus of FIG. 1.

The conveying and mixing by the material handling system 46 is provided by paddles 74 supported by arms 76 at spaced apart locations within the internal cavities 20, 22 of segments 14, 16 of mixing chamber 12. As best seen in FIG. 4A, the arms 76 are supported by collar members 78, each of which includes a semi-cylindrical portion and opposite flanged edge portions. A pair of collar members 78 is secured to shaft 60 by positioning the members of the pair on opposite sides of shaft 60 such that the flanged edge portions of one of the collar members confronts the flanged portions of the other collar member. Bolted connectors 80 extending through the flanged portions of the generate compressive force between the semi-cylindrical portions of collar members 78 and shaft 60 to secure the collar members to the shaft. Alternatively, the arms 76 could be bolted directly to the shaft 60 or the arms and shaft could incorporate torque transmitting surfaces or keyways, or a combination of both could be utilized. The paddles 74 are bolted to the arms 76. The use of a bolted attachment provides for adjustability in the positioning of paddle 74 with respect to the arm 76. Alternatively, the paddle may be secured to the arms by other means such as welding or may be integral with the arms. Similarly, the arms may be integral with collar members 78 or secured by other means such as welding.

As best seen in FIG. 4A, the arms 76 include bends 79. The bends serve to orient the supported paddle to provide a "scooping" action in which the paddle imparts to the landscaping material an inward radial movement in addition to a tangential component. The scooping action of the paddles may also be enhanced further by providing a curved surface contacting the material. The addition of the inward radial movement to the tangential movement serves to increase the mixing action provided by the paddles.

Figure 5:
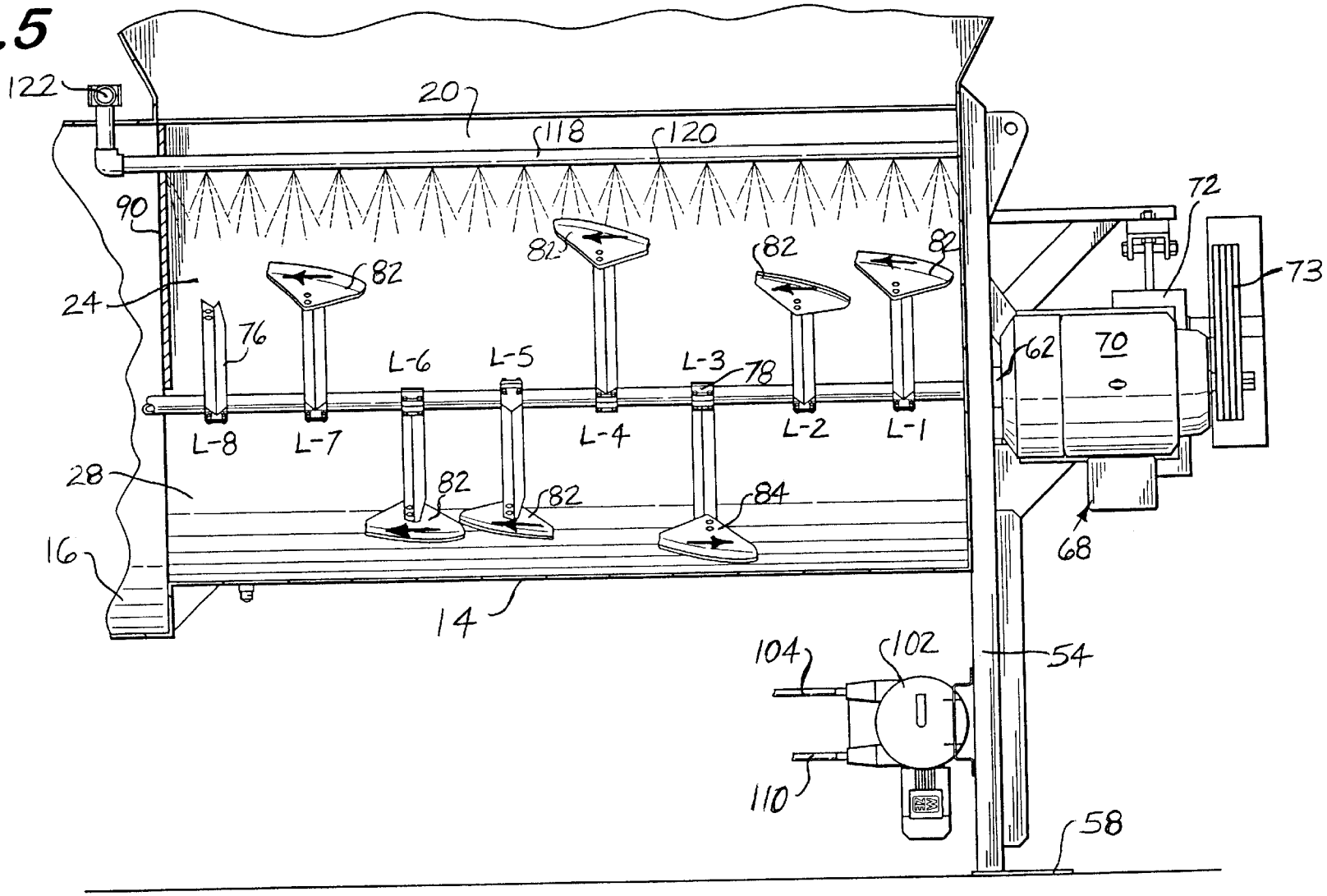
FIG. 5 is a side view of a first segment of a mixing chamber in FIG. 1 with a portion of the chamber wall removed.
Figure 6:
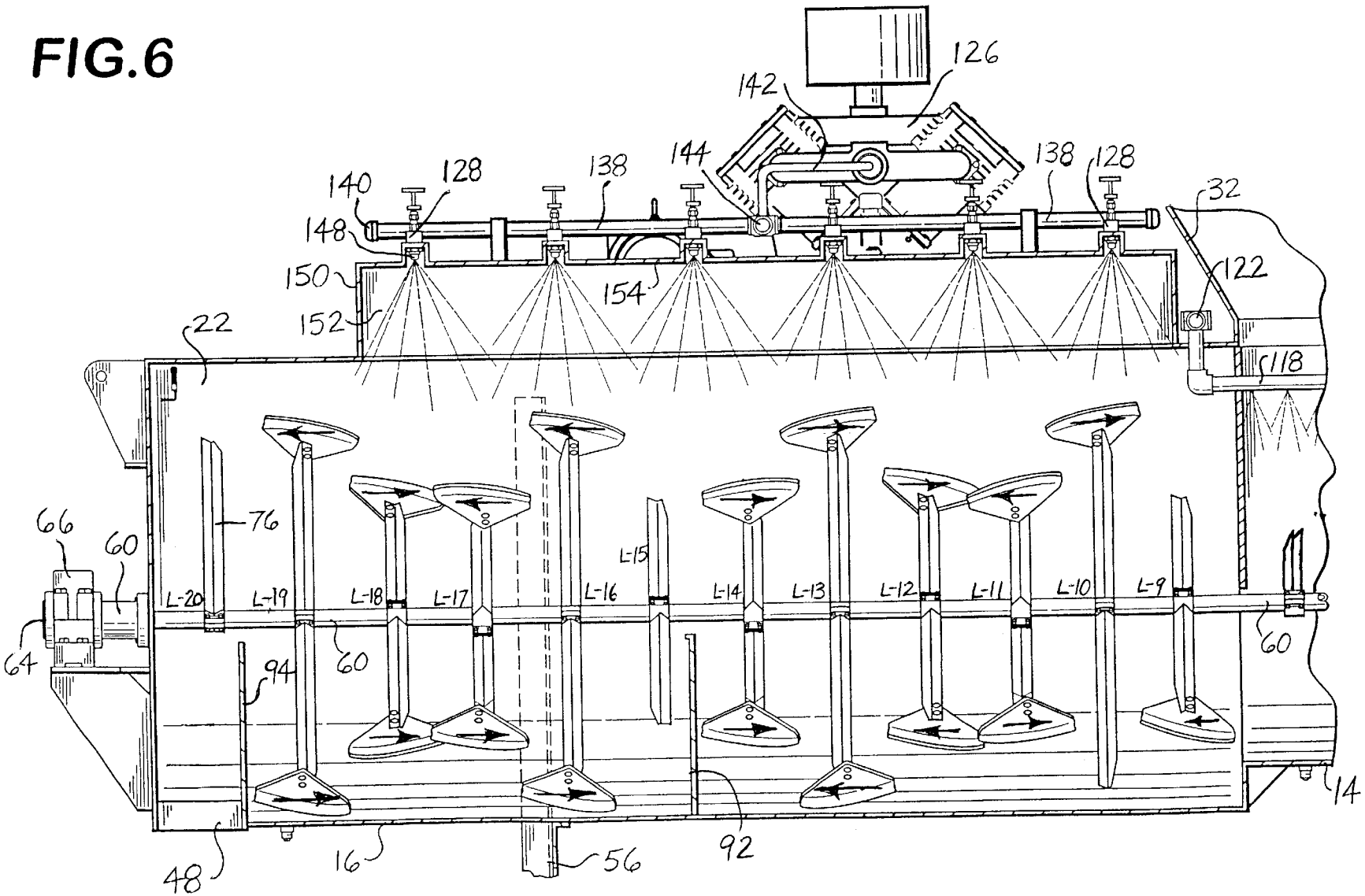
FIG. 6 is a side view of a second segment of the mixing chamber in FIG. 1 with a portion of the chamber wall removed.

The arrangement and orientation of the arms and paddles is varied throughout mixing chamber 12. Referring to FIG. 5, the locations of the arms within the first segment 14 of mixing chamber 12 are numbered L-1 to L-8 beginning at the upstream end of first segment 14 which is adjacent shaft drive system 68. Each of these locations are single arm locations wherein only one arm is secured to shaft 60 at that location. Referring to FIG. 6, the arm locations within the second segment 16 of mixing chamber 12 are numbered L-9 to L-20 beginning at the upstream end of second segment 16 which is adjacent segment juncture 18. Each of these locations, with the exception of L-20, are double arm locations wherein the collar members at that location support a pair of arms 76 such that the arms extend from shaft 60 oppositely from one another. The excepted arm location L-20 adjacent discharge opening 48 is a single arm location. Certain of the arm locations, namely locations L-8 to L-10, L-and L-20, are "arm only" locations wherein at least one paddleless arm 76 is supported by the shaft at that location.

The dwell time of landscaping material within a particular region, and therefore the mixing of the material, is increased by a paddle arrangement which moves material in an upstream direction as well as a downstream direction. Referring to FIGS. 3 through 6, the paddles 74 include forward paddles 82 and reverse paddles 84 which impart either a downstream or upstream axial component of movement to material contacted by the paddle. This axial component is in addition to the tangential and radial movements imparted by the scooping action of the paddles. This is best seen in FIG. 4A, which is a partial perspective view of a double arm location looking generally in the downstream direction toward discharge opening 48. A forward paddle 82 includes a face surface 86 which is angled with respect to shaft 60 to impart a downstream component of movement towards discharge opening 48 to the landscaping material. Conversely, a reverse paddle 84 includes a face surface 88 which is angled with respect to shaft 60 to impart an axial material movement in an upstream direction, i.e. away from the discharge opening 48. The axial components of material movement for the paddles of the double arm location of FIG. 4A are indicated by the arrows.

Figure 3:
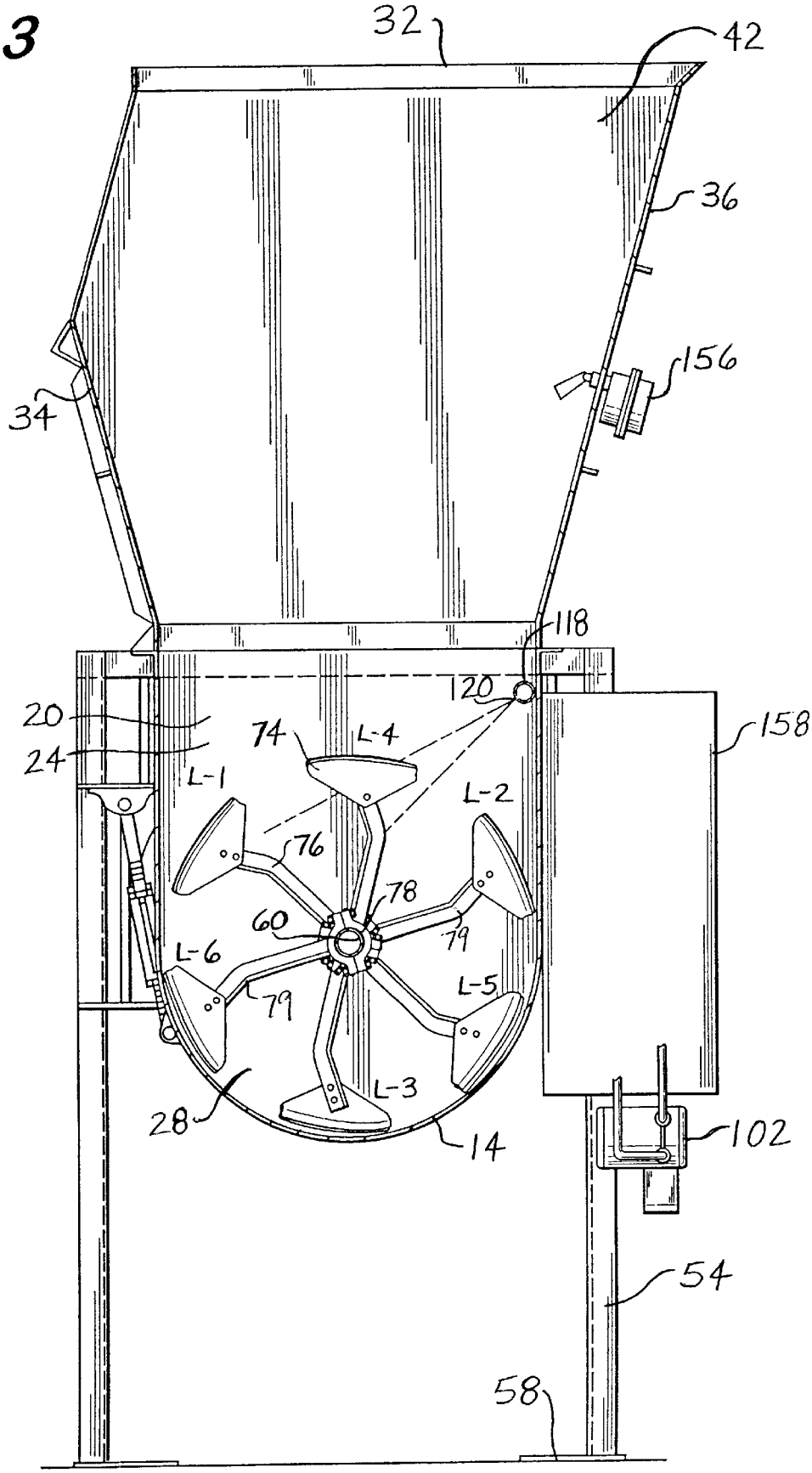
FIG. 3 is a sectional view taken along lines 3—3 in FIG. 1.

Focusing initially on the first segment 14, the mixing action of the material handling system 46 is also increased by variation in the relative angular orientation of arms 76 about shaft 60 along the length of the first segment 14 as seen in FIGS. 3 and 5. Each of arms in the set of arms at locations L-1 to L-3 is out of alignment with an adjacent arm of this set by approximately 120 degrees. The 120 degree pattern is discontinued at location L-4 which is out of alignment with the arm at location L-3 by approximately 180 degrees, i.e. on opposite side of shaft 60 from the arm at location L-3. The pattern of 120 degree misalignment recommences with the set of arms at locations L-4 to L-6 such that each of arms in the set of arms at locations L-4 to L-6 is out of alignment with an adjacent arm from this set by approximately 120 degrees. The angular misalignment of the arms 76 provides for increased mixing of landscaping material being conveyed through the first segment 14.

The dwell time, and therefore the mixing of material, is increased in the first segment 14 of mixing chamber 12 by the inclusion of a first flow controller 90 which controls the flow of the material from the first segment 14 to the second segment 16. Referring to FIG. 5, the first flow controller 90 is located at segment juncture 18 and extends transversely with respect to the length of second segment 16 and inwardly with respect to mixing chamber 12 along the upper portions 24, 26 of segments 14, 16, respectively. The inclusion of first flow controller 90 causes material passing from the first segment 14 to the second segment 16 to enter the second segment in lower portion 30. The resulting restriction in the passageway between the first segment 14 and the second segment 16, serves to dramatically increase the dwell time of material within the first segment 14 of the mixing chamber 12. The location of flow controller 90 at the upper portions 24, 26 serves to direct material entering from the hopper adjacent the segment juncture 18 into the first segment for initial introduction of liquid colorant and prevents more direct passage of material into the second segment which would occur in the absence of a flow controller in this location. The orientation of the blades in the first segment 14 creates an exaggerated flow of material towards the flow controller 90 at the upper portions 24, 26. The forces of the blades on the material against the flow controller 90 creates a less fluidized agitation gradient above arm positions L-1 through L-8 that extends into the hopper. The agitation zone above L8 is the least fluidized and the zone above L1 is the most fluidized. As uncolored material is loaded into the hopper, they float from the lesser fluidized zones near L8 to the higher fluidized zones near L1. Providing a fluidization gradient throughout the first segment 14 increases dwell time of material within first segment 14 regardless of the entry point of the material into the hopper. The increased dwell time increases material mixing and enhances the distribution of an initial portion of colorant by the colorant distribution system 52 to the landscaping material being colored by apparatus 10.

The movement of landscaping material provided by the material handling system 46 in the highly fluidized zone of first segment 14 is therefore a free flowing motion which includes upstream and downstream movement of material as well as tangential and radial movement. The paddle and arm arrangement serves to limit bridging of material in which the material would tend to mechanically interlock in the form of an arch rather than in free flowing motion. In the first segment 14, the colorant introduced to the material will be mixed by a scrubbing of material against material which is distinct from the mixing action in the second segment 16, to be described. The arm and blade arrangement of the first segment 14 also results in interaction between material moving in the first segment with material at the lower portion of the hopper 32. This interaction limits bridging of material at the boundary between the hopper and the first segment thereby eliminating the need for separate agitators to perform this function.

The paddle arrangement in the second segment 16 also utilizes an arrangement of paddles incorporating reverse paddles in addition to forward paddles for increased dwell time and increased mixing of material. The paddle arrangement of the arm locations within the second segment 16, illustrated by the arrows in FIG. 6, includes: forward/reverse combinations (L-11 to L-13, L-16, L-17 and L-19); reverse/reverse combinations (L-14 and L-18); forward/arm only combination (L-9); reverse/arm only combination (L-10); arm only/arm only combination (L-15) and an arm only single arm location (L-20).

The advantages of the arm arrangement of the second segment 16 include the following. The single paddle/arm only combinations at arm locations L-9 and L-10 serve to limit passage of material from the first segment 14 into the second segment 16 by pulling material away from the flow controller 90 only one time per revolution of the shaft 60. The arm only portions provide additional agitation without moving the material in either axial direction, thus limiting paddle blockage at the interface between the segments. The single arm only location at location L-20 facilitates passage of material past the third flow controller 94 to the discharge opening 48 and prevents bridging of material. The forward and reverse paddles at the L-9 and L-10 locations, respectively, provide initial mixing and conveying of material within the second segment 16. The forward/reverse paddle combinations at locations L-11 to L-13 provide a region of increased mixing for material conveyed therethrough in comparison with locations L-9 and L-10. The reverse/reverse combination at location L-14 facilitates mixing through interaction with the combination at location L-14 and also serves to increase dwell time for material within the region of increased mixing provided by paddles at location L-11 to L-13. Similarly, the forward/reverse paddle combinations at locations L-16 and L-17 provide for mixing within this particular region while the reverse/reverse combination at location L-18 facilitates mixing and increases dwell time for that region.

Similar to the first segment 14, the relative angular orientation of the arms 76 of the double arm locations of the second segment 16 about shaft 60 varies along the length of the second segment to provide for increased mixing. The arms 76 of each of the double arm locations, considered together as a combination is out of alignment with an adjacent double arm combination by approximately 120 degrees. This pattern of 120 degree misalignment between succeeding arm combinations continues throughout the arm combinations of the second segment 16.

The apparatus 10 includes additional flow controllers in the second segment 16 to control dwell time and mixing of material being conveyed through second segment 16. The apparatus includes a second flow controller 92 located at an intermediate location along the length of second segment 16 between arm location number L-14 and L-15. The second flow controller 92 extends transversely and inwardly into internal cavity 22 along the lower portion of second segment 16 to direct material passing second flow controller 92 in upper portion 26 of second segment 16. The inclusion of the flow controller at this location, and the resulting restriction in the passageway for material flow at this location, works in combination with the afore-mentioned reverse/reverse paddle combination at location L-14 to increase mixing of material in the zone of locations L-11 to L-13 by increasing dwell time of material within this zone prior to passage of the material at the upper portion 26 beyond the second flow controller 92.

A third flow controller 94 is located adjacent to discharge opening 48 along lower portion 30 of second segment 16. The third flow controller 94 facilitates mixing of the landscaping material by increasing dwell time of material within the zone including locations L-16 to L-19 by directing the material to upper portion 26 of segment 16 prior to exit of the material from mixing chamber 12 to conveyor 50 via the discharge opening 48.

The movement of landscaping material by the material handling system 46 is coordinated with the segmented introduction of colorant by the colorant distribution system 52, to be described in greater detail, for optimizing the distribution of colorant through the material being colored. The relatively larger cross sectional area of the second segment 16 in combination with the flow restriction provided by the first flow controller 90 creates open space in the second segment with respect to the material moving in the segment which is not present in the first segment 14. As best seen in FIG. 1A, the relatively large cross sectional area of the second segment 16 also allows for the use of longer arms in the second segment 16 in comparison with the arms in the first segment 14. Therefore, paddles may be supported by arms in the second segment 16 for rotation about shaft 60 at a larger radius than the paddles in the first segment 14. It is known that an object rotating about an axis at a given speed of rotation will experience a tangential tip speed at the outermost edge of the object which will vary in proportion to the distance from the axis of rotation to the outermost edge of the object. For the paddle arrangement of the figures in which the paddles of both segments are rotated by the same shaft, the tip speed for the paddles of the second segment 16 will be larger than the tip speed for the paddles of the first segment 14.

Increased tip speed in the second segment 16 is highly beneficial for enhancing the mixing of colorant and landscaping material in the apparatus of the present invention. The increased tip speed enhances the colorant distribution system 52, to be described later in greater detail, in which a portion supplying the second segment includes an atomizer system for delivering the colorant to the second segment in an aerosol form in contrast to a portion supplying the first segment in which a colorant is delivered in the form of a liquid spray. The atomizing of the colorant into aerosol form in the second segment 16 results in a given amount of colorant being dispersed over a much larger volume in the second segment in contrast with the liquid spray colorant in the first segment 14. It is therefore beneficial that the paddles in the second segment move the landscaping material at a larger radius and faster speed to further disperse the material and compensate for the increased dispersement of the colorant. It is therefore appropriate that combination of the larger cross sectional area of the second segment 16 and the flow restriction of the first flow controller 90 provide open space for the material of the second segment 16 for the increased dispersement capabilities of the higher tip speed paddles of the second segment 16. The higher tip speed when combined with the angle of the arm and the rolled shape of the blades scoop and throw the landscaping material into the open region which contains atomized colorant particles, thus exposing all surfaces of the landscaping material to the aerosol colorant. The high energy mixing of landscaping material within a blanket of aerosol colorant produces a more homogeneous blend with less water and colorant usage compared to systems only utilizing a material to material scrubbing action to spread colorant.

The following describes the segmented introduction of colorant by the colorant distribution system 52 in greater detail. The colorant distribution system 52 includes a first portion 96 which delivers a supply of a liquid colorant to the internal cavity 20 of first segment 14 in the form of a liquid spray and a second portion 98 which delivers liquid colorant to internal cavity 22 of second segment 16 in the form of an aerosol. As may be seen in FIGS. 5 and 6, the colorant distribution system 52 provides for introduction of colorant to the landscaping material along substantially the entire length of the mixing chamber 12. The segmented distribution of colorant provided by apparatus 10 provides for increased efficiency in colorant and water usage as well as enhanced uniformity in colorant distribution throughout the material. Liquid colorant in concentrated form for both the first and second portions 96, 98 of the colorant distribution system is stored in container 100. A pump 102, secured to support member 54 and connected to container 100 by hose 104, conveys concentrated colorant to pipe junction 106 in hose 110 through shut-off valve 108. Water is introduced to pipe junction 106 via inlet pipe 112 through shut-off valve 114 to mix with and dilute the concentrated colorant. Liquid colorant in diluted form is then conveyed to both portions 96, 98 of the colorant distribution system 52 in supply pipe 116.

The first portion 96 of the colorant distribution system 52 delivers colorant to the first segment 14 in a relatively less dispersed liquid spray form in the following manner. The first portion 96 includes a length of pipe 118 extending in the internal cavity 20 of first segment 14 in upper portion 24. The pipe 118 has spaced apart openings 120 for delivering liquid to the first segment 14 in a liquid spray form which is distinguishable from the aerosol form of the second segment to be described below. The liquid colorant of the first portion 96 is supplied to pipe 118 from the supply pipe 116 via cross pipe 122. As best seen in FIG. 3, the pipe openings 120 are located approximately 30 degrees downwardly from horizontal which results in an inwardly downwardly direction of the liquid spray exiting from pipe 118. In this manner, the liquid spray is introduced to the material being mixed in the first segment 14 at the most effective location.

The colorant distribution system 52 is coordinated with the material handling system 46 in the first segment 14 of mixing chamber 12 to optimize distribution of colorant through the landscaping material. The paddles 74 supported by the shorter arms 76 of the first segment 14 move material at a slower tip speed and therefore in a less dispersed condition than the longer arms of the second segment 16. The colorant distribution system 52 accordingly applies the colorant to the material in the first segment 14 in the relatively less dispersed liquid spray form in contrast to the aerosol form of the second segment 16. The coordination of the colorant distribution system 52 with the material handling system 46 in the first segment 14 provides for introduction of an initial portion of colorant for continuing mixing by the material handling system 46.

The colorant distribution system 52 is also coordinated with the material handling system 46 in the second segment 16 of mixing chamber 12 to further optimize distribution of colorant through the landscaping material. The second portion 98 of the colorant distribution system 52 delivers colorant to the second segment 16 in a relatively more dispersed aerosol form in the following manner. The second portion 98 includes an atomizer system 124 extending into the internal cavity 22 of the mixing chamber second segment 16. The atomizer system 124 includes an air compressor 126 which is mounted on mixing chamber 12 above the second segment 16. The atomizer system 124 further includes atomizer nozzles 128 at spaced apart locations along a length of the mixing chamber second segment 16.

Liquid colorant from supply pipe 116, serving both the first and second portions 96, 98 of the colorant distribution system, is supplied to the second portion 98, through transfer pipe 134 and tee-joint 136 to opposite pipe segments 130 each having an end cap 132. As best seen in FIG. 4, each of the atomizer nozzles 128 is connected to one of the colorant supplying pipe segments 130 through pipe nipple assemblies 136. The nipple assemblies 136 tap into pipe segments 130 at the spaced apart locations of the atomizer nozzles 128. The atomizer system 124 includes air supply pipe segments 138 each having an end cap 140 which extend along a length of the second segment 16 oppositely from colorant supply pipe segments 130 such that the atomizing nozzles 128 are located between pipe segments 130 and 138. Pressurized air from air compressor 126 is supplied to pipe segments 138 through air compressor hose 142 and inlet 144. Each of atomizer nozzles 128 is supplied with pressurized air from one of air supply pipe segments 138 through a hose 146. As best seen in FIG. 4, liquid colorant and pressurized air are directed into each of nozzles 128 from opposite sides such that the liquid colorant and pressurized air are ejected from nozzle discharge 148 into the second segment 16 in the form of a highly dispersed aerosol.

To facilitate mixing of the colorant with landscaping material in the second segment 16, the apparatus 10 includes an elongated dispersing chamber 150 having an internal cavity 152 communicating with the internal cavity 22 at the upper portion 26 of second segment 16. Each of the atomizer nozzles 128 of the atomizer system 124 is mounted to the dispersing chamber 150 along a side 154 of the dispersing chamber opposite the internal cavity 22 of second segment 16. As can be seen in FIG. 4, the internal cavity 152 of dispersing chamber 150 provides a location for expansion of the aerosol which is ejected from atomizer nozzles 128 before the aerosol enters the internal cavity 22 of second segment 16. This expansion of the aerosol facilitates dispersion of the colorant through the material being mixed in the second segment 16 of mixing chamber 12.

The material handling system 46 is coordinated with the second portion 98 of the colorant distribution system 52 in the second segment 16 in the following manner. The paddles 74 supported by the longer arms 76 of the second segment 16 move material in the outward regions of the second segment 16 at a higher tip speed and in a more dispersed condition than the shorter arms of the first segment 14. The colorant distribution system 52 utilizes the atomizer system 124 to introduce the more highly dispersed aerosol in the second segment 16 for optimum application of the final portion of the colorant to the more highly dispersed material adjacent to the atomizer nozzles 128. The application of colorant in the segmented portions of the present invention utilizing a relatively less dispersed liquid spray in the lower speed first segment and a relatively more dispersed aerosol to the higher speed second segment results in more efficient use of colorant and greater uniformity in the distribution of colorant throughout the landscaping material which is conveyed through the mixing chamber 12.

The apparatus 10 includes a material sensor 156 secured to side wall 36 of hopper 30 for use in control of the colorant distribution system 52 and/or material handling system 46. The sensor 156 is connected to a control unit 158 mounted on a side of mixing chamber 12 by signal line 160. The sensor 156 extends into the internal cavity 42 of hopper 30 as best seen in FIG. 3 and monitors the proximity of landscaping material in the hopper adjacent to the sensor. When the level of landscaping material in the hopper reaches at least to the height of the sensor 156, the sensor generates a system start signal. The signal is transmitted to the control unit 158 via signal line 160 indicating that a sufficient supply of material to be colored is in the hopper for start up of the material handling system 46 by the control unit 158. A programmable amp meter or a hydraulic pressure transducer monitors the power which is drawn by the drive motor 70 of the shaft drive system 68. The power required by the motor 70 will vary depending on the amount of landscaping material being handled by the material handling system 46 in the mixing chamber 12. When sufficient landscaping material is supplied to the mixer from the hopper, the power required by drive motor 70 will actuate a signal from the sensor 156 to start the colorant distribution system 52. When landscaping material is no longer being supplied to the mixer from the hopper, at the end of a supply run for example, the power required by motor 70 will be reduced as the amount of material being driven by the material handling system 46 is reduced. The information regarding power drawn by the motor 70 is transmitted to the control unit 158 for shut-down of the colorant distribution system 52 and/or shut-down of the material handling system 46 when the power drawn by the motor 70 is reduced to predetermined levels. Shut-down of the colorant distribution system 52 and the material handling system 46 may be set at different levels. This prevents excessive amounts of colorant and water being added to the landscaping material, at the end of a supply run for example, while allowing for continued mixing.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus for coloring granular or particulate landscaping material comprising:

a mixing chamber including first and second elongated segments each defining an internal cavity having a transverse width, the internal cavity of said second segment communicating with the internal cavity of said first segment for passage of said landscaping material from said first segment to said second segment;

a colorant distribution system for delivery of a liquid colorant, said distribution system having first and second portions, said first portion including at least one member located within the internal cavity of said first segment and delivering the liquid colorant in the form of a liquid spray into the first segment, said second portion having an atomizer system for delivering the liquid colorant in the form of an aerosol spray that is more finely dispersed than the liquid spray of the first segment; and a material handling system extending through the internal cavities of said first and second segments for mixing of said colorant and said landscaping material within said mixing chamber and for conveying of said landscaping material through said mixing chamber.

2. The apparatus according to claim 1, wherein the first portion of said colorant distribution system includes at least one elongated pipe extending in the internal cavity of said first segment and having openings at spaced apart locations along a length of said pipe.

3. The apparatus according to claim 1, wherein the atomizer system of said second portion includes an atomizer nozzle at each of spaced apart locations along a length of said second segment.

4. The apparatus according to claim 3 further including an elongated dispersing chamber having an internal cavity communicating with the internal cavity of said second segment and wherein said atomizer nozzles are operably secured to a side of said dispersing chamber opposite said second segment.

5. The apparatus according to claim 1 wherein said material handling system includes at least one paddle in each of the first and second segments of said mixing chamber, each of said paddles operably supported by said material handling system for rotation about an axis.

6. An apparatus for coloring granular or particulate landscaping material comprising:

a mixing chamber including first and second elongated segments each defining an internal cavity, the internal cavity of said second segment communicating with the internal cavity of said first segment for passage of said landscaping material from said first segment to said second segment;

a colorant distribution system for delivery of a liquid colorant, said distribution system having first and second portions, said first portion extending into the internal cavity of said first segment and delivering the liquid colorant in the form of a liquid spray, said second portion extending into the internal cavity of said second segment and having an atomizer system for delivery of the liquid colorant in the form of an aerosol; and a material handling system extending through the internal cavities of said first and second segments for mixing of said colorant and said landscaping material within said mixing chamber and for conveying of said landscaping material through said mixing chamber, said material handling system including at least one paddle in each of the first and second segments of said mixing chamber, each of said paddles operably supported by said material handling system for rotation about an axis, the at least one paddle of said second segment having a tip speed which is larger than a tip speed of the at least one paddle of said first segment.

7. The apparatus according to claim 6 wherein said material handling system includes a rotatably supported shaft extending through the first and second segments of said mixing chamber, and wherein each of said paddles is supported by an arm extending from said shaft and having a length such that the length of the arms located in said second segment is greater than the length of the arms located in said first segment.

8. An apparatus for coloring granular or particulate landscaping material comprising:

a mixing chamber including first and second elongated segments each defining an internal cavity, the internal cavity of said second segment communicating with the internal cavity of said first segment for passage of said landscaping material from said first segment to said second segment;

a colorant distribution system for delivery of a liquid colorant, said distribution system having first and second portions, said first portion extending into the internal cavity of said first segment and delivering the liquid colorant in the form of a liquid spray, said second portion extending into the internal cavity of said second segment and having an atomizer system for delivery of the liquid colorant in the form of an aerosol; and a material handling system extending through the internal cavities of said first and second segments for mixing of said colorant and said landscaping material within said mixing chamber and for conveying of said landscaping material through said mixing chamber, said material handling system including at least one paddle in each of the first and second segments of said mixing chamber, each of said paddles operably supported by said material handling system for rotation about an axis, said paddles including forward and reverse paddles to facilitate mixing, said forward paddles having a face surface angled with respect to said shaft to impart an axial component of movement to said landscaping material in a downstream direction with respect to said mixing chamber and said reverse paddles having a face surface angled with respect to said shaft to impart an axial component of movement to said landscaping material in an upstream direction with respect to said mixing chamber.

9. The apparatus according to claim 1 further including a material flow controller extending into the mixing chamber between the internal cavities of said first and second segments, said material flow controller extending transversely with respect to an elongated length of said second segment.

10. The apparatus according to claim 9, wherein said material flow controller extends across an upper portion of the internal cavity of said second segment adjacent the internal cavity of said first segment for directing said landscaping material from said first segment to said second segment at a lower portion of said second segment.

11. The apparatus according to claim 10 further including a second material flow controller which extends into the internal cavity of said second segment transversely with respect to the elongated length of said second segment, said second material flow controller extending across a lower portion of said second segment for directing said landscaping material in an upper portion of said second segment.

12. The apparatus according to claim 8 wherein said material handling system includes single arm locations and double arm locations in which a single arm location has one arm extending from said shaft at that location and a double arm location has arms extending from said shaft in each of two opposing directions at that location.

13. The apparatus according to claim 12 wherein said material handling system includes double arm locations within said second segment in which one of said arms supports a forward paddle and the opposite of said arms supports a reverse paddle.

14. The apparatus according to claim 7 wherein said material handling system includes a drive system secured to an end of said shaft for rotatably driving said shaft and wherein said material handling system further includes a hopper having an internal cavity communicating with the internal cavity of said first segment for introducing landscaping material to be colored by said apparatus into the internal cavity of first segment.

15. The apparatus according to claim 14 further including a material sensor extending into the internal cavity of said hopper at a height above said first segment for generating a system start signal when a level of said landscaping material within said hopper extends at least to the height of said sensor.

16. The apparatus according to claim 15 further including a control unit operably connected to either one or both of said material handling system and said colorant distribution system, said control unit further connected to said material sensor for start up of one or both of said material handling system and said colorant distribution system following receipt of said system start signal from said material sensor.

17. An apparatus for coloring granular or particulate material comprising:

a mixing chamber having first and second segments each defining an internal cavity;

a colorant distribution system adapted to deliver a liquid colorant into the internal cavity of at least one of the first and second segments of the mixing chamber; and a material handling system extending through the internal cavities of the first and second segments of the mixing chamber for mixing liquid colorant with granular or particulate material and for conveying the material through the mixing chamber, the material handling system including a plurality of paddles located in the internal cavities of each of the first and second segments of the mixing chamber, the paddles supported for rotation about a common axis, at least one of the paddles of the second segment having a tip speed that is larger than a tip speed of each of the paddles of the first segment.

18. An apparatus for coloring granular or particulate material comprising:

a mixing chamber having first and second segments each defining an elongated internal cavity, the internal cavity of the first segment communicating with a feed system for receipt of granular or particulate material by the first segment, the internal cavity of the second segment communicating with an outlet adjacent an end of the second segment opposite the first segment for discharge of material from the mixing chamber, a colorant distribution system adapted to deliver a liquid colorant into the internal cavity of at least one of the first and second segments of the mixing chamber; and a material handling system extending through the internal cavities of the first and second segments of the mixing chamber, the material handling system including at least one rotating member in the internal cavity of each of the first and second segments having a surface that is oriented to move material toward the outlet, the material handling system further including at least one rotating member in at least one of the first and second segments having a surface oriented to move material away from the outlet to increase dwell time of material in the segment thereby facilitating mixing of the material.

19. The apparatus according to claim 18, wherein the material handling system includes at least one paddle in each of the first and second segments of the mixing chamber, the paddles supported by a rotatable shaft for rotation about a common axis, at least one paddle of each of the first and second segments having a face surface angled with respect to the shaft to impart an axial component of movement to the material toward the outlet, at least one paddle of at least one of the first and second segments having a face surface angled with respect to said shaft to impart an axial component of movement to the material away from the outlet.

20. An apparatus for coloring granular or particulate landscaping material comprising:

a mixing chamber including first and second elongated segments each defining an internal cavity having a transverse width, the internal cavity of said second segment communicating with the internal cavity of said first segment in substantial alignment therewith for passage of landscaping material from the first segment to the second segment, the transverse width of the second segment being greater than the transverse width of the first segment;

a colorant distribution system for delivery of liquid colorant, said distribution system having first and second portions, the first portion including at least one member located within the internal cavity of the first segment and delivering liquid colorant in the form of a liquid spray along substantially the entire length of the first segment, the second portion having an atomizer system delivering liquid colorant in the form of an aerosol spray that is more finely dispersed than the liquid spray of the first segment; and a material handling system extending through the internal cavities of the first and second segments for mixing of colorant and landscaping material within said mixing chamber and for conveying of landscaping material through the mixing chamber.

* * * * *